US007055511B2

(12) United States Patent
Glenz et al.

(10) Patent No.: US 7,055,511 B2
(45) Date of Patent: Jun. 6, 2006

(54) FUEL SUPPLY SYSTEM INCLUDING A PUMP UNIT

(75) Inventors: Andreas Glenz, Kernen i.R. (DE); Guenter Hoenig, Ditzingen (DE); Eberhard Holder, Esslingen (DE); Martin Matt, Bruchsal-Untergrombach (DE); Andreas Posselt, Mühlacker (DE)

(73) Assignees: DaimlerChrysler AG, Stuttgart (DE); Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/110,988

(22) Filed: Apr. 20, 2005

(65) Prior Publication Data

US 2005/0224056 A1 Oct. 13, 2005

Related U.S. Application Data

(63) Continuation-in-part of application No. PCT/EP03/11156, filed on Oct. 9, 2003.

(30) Foreign Application Priority Data

Oct. 26, 2002 (DE) ..... 102 49 953

(51) Int. Cl.
*F02B 1/00* (2006.01)

(52) U.S. Cl. ..... 123/576; 123/497

(58) Field of Classification Search ..... 123/1 A, 123/522, 525, 575, 576, 497, 179.16; 417/223
See application file for complete search history.

(56) References Cited

U.S. PATENT DOCUMENTS

| | | | | |
|---|---|---|---|---|
| 3,640,254 A | | 2/1972 | Manfredi | |
| 4,813,234 A | * | 3/1989 | Nikolaus | 60/484 |
| 6,067,969 A | * | 5/2000 | Kemmler et al. | 123/548 |

FOREIGN PATENT DOCUMENTS

| | | |
|---|---|---|
| DE | 40 04 500 | 8/1991 |
| DE | 43 38 095 | 6/1994 |
| DE | 195 13 822 | 10/1996 |
| DE | 195 30 421 | 2/1997 |
| DE | 100 64 592 | 7/2002 |
| EP | 0 554 928 | 8/1993 |
| EP | 1 002 842 | 5/2000 |
| WO | WO 99/13938 | 9/1999 |
| WO | WO 02/14678 | 2/2002 |

* cited by examiner

*Primary Examiner*—Mahmoud Gimie
(74) *Attorney, Agent, or Firm*—Klaus J. Bach

(57) ABSTRACT

In a fuel supply system for an internal combustion engine in which a gas delivery pump, a fuel pump and an electric motor are included in the fuel supply system and form a pump unit, the electric motor is incorporated in the system in such a way that it can selectively drive either one or both of the pumps.

5 Claims, 6 Drawing Sheets

FUEL SUPPLY SYSTEM INCLUDING A PUMP UNIT

This is a Continuation-In-Part Application of International Application PCT/EP03/11156 filed Oct. 9, 2003 and claiming the priority of German application 102 49 953.5 filed Oct. 26, 2002.

BACKGROUND OF THE INVENTION

The invention relates to a fuel supply system for an internal combustion engine having a fuel tank for liquid fuel, a fuel storage unit and a device for separating low boiling fuel fractions from the fuel for storage in the storage unit.

A fuel supply system of this type is known from DE 197 34 493 C1. This fuel supply installation is provided with a fuel tank for liquid fuel, from which a fuel feed line leads to an injection apparatus, with an evaporation and condensing device for low boiling-point fuel fractions, which is connected to the fuel tank, with an intermediate tank for the condensate, connected after the evaporation and condensing device, from which a condensate line leads to a control valve controlling the supply to the injection device, and with a residual fuel return line discharging the higher boiling-point residual fuel fractions accumulating in the evaporation and condensing device. The residual fuel return line opens into an additional tank, from which a residual fuel feed line leads to a changeover valve arranged in the fuel feed line. The control of the valve is such that, under full load of the internal combustion engine, the residual fuel from the residual fuel feed line is at least partly fed into the fuel feed line leading to the injection device.

Because of emission limits established world-wide nowadays, with statutorily prescribed exhaust gas emission limiting values, a fuel supply system having a fuel fractionation device for producing low boiling-point fuel fractions is needed in a motor vehicle operated with internal combustion engines, in order to reduce the pollutant emissions during the operation of a motor vehicle in the cold-start and/or warm-up phase and to reduce the discharge of pollutant overall. Such systems are frequently complicated in terms of apparatus and of design and therefore need a large overall volume with a corresponding overall weight.

It is therefore an object of the invention to provide a fuel supply system for an internal combustion engine which has only a low overall volume and a low overall weight in conjunction with a reduced pollutant emission during the various operating phases of the motor vehicle.

SUMMARY OF THE INVENTION

In a fuel supply system for an internal combustion engine in which a gas delivery pump, a fuel pump and an electric motor are included in the fuel supply system and form a pump unit, the electric motor is incorporated in the system in such a way that it can selectively drive either one or both of the pumps required for the operation of the system.

According to a particularly preferred embodiment of the fuel supply system according to the invention, a clutch is provided between the electric motor and the fuel pump and/or between the electric motor and gas delivery pump.

In a very advantageous embodiment of the invention at least one control valve is arranged on the intake and pressure side of the fuel pump in such a way that liquid fuel from the fuel tank, also designated the main fuel tank, or fuel having low boiling-point fractions from the additional tank, also designated the starting fuel tank, can be delivered as desired by the fuel pump. According to the invention, by means of the fuel pump, excess fuel having low boiling-point fractions can also be returned to the additional tank via a fuel return line. As a further advantage, in this way it is possible for starting fuel once obtained to be saved, in order to have it available in the shortest possible time, for example for reducing the exhaust gas emissions in cold-start situations. As a result of the considerable reduction in the pollutant emission, in particular in the emissions of hydrocarbons, this advantageously results firstly in a reduction of the catalyst (noble metal) content in the exhaust gas catalytic converters, and secondly, the elimination of a need for catalytic converters close to the engine, which, because the high temperatures in this region, are subjected to rapid ageing.

An important feature is also that the pump unit of the fuel supply installation can easily be installed into the fuel tank of a vehicle.

Because of the aforementioned advantages, the apparatus according to the invention is suitable for use in all mobile systems, such as passenger and utility vehicles.

The invention will now be described in greater detail on the basis of the appended drawing:

DESCRIPTION OF A PREFERRED EMBODIMENT

Figure 1:
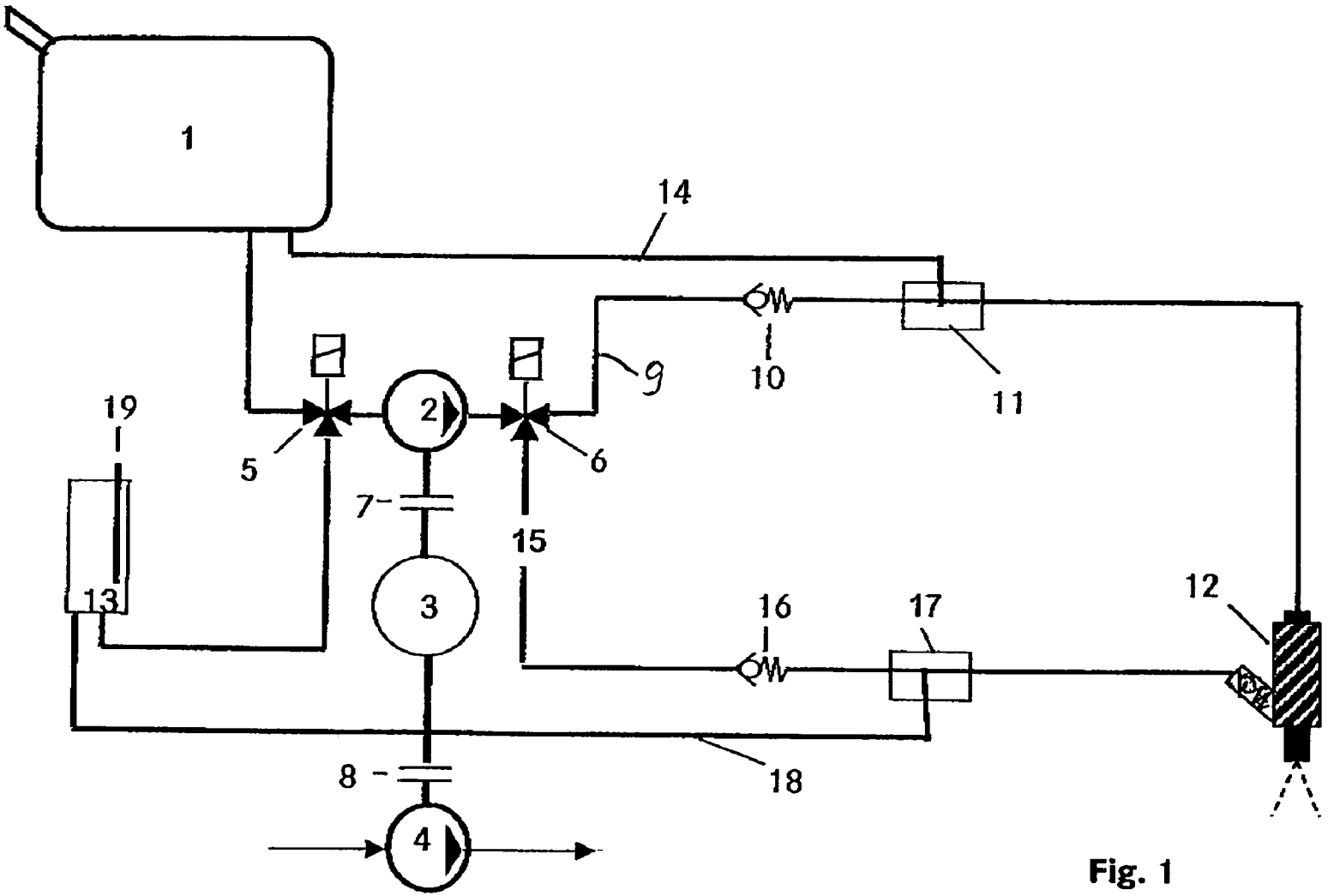
FIG. 1 shows a preferred embodiment of the overall system of a fuel supply installation.

FIG. 1 shows the overall system of a fuel supply system, with the various operating modes or functions of the installation illustrated in FIGS. 2 to 6: operation with main fuel, flushing with starting fuel, operation with starting fuel, first filling with starting fuel and the operation of the gas delivery pump, which will be explained below. The overall system advantageously permits, firstly, the production of starting fuel and, secondly, the simultaneous management of the delivery of main fuel and starting fuel.

FIG. 1 shows a pump unit comprising a fuel pump 2, an electric motor 3 and a gas delivery pump 4. A clutch 7 is provided between the fuel pump 2 and the electric motor 3, and a clutch 8 is provided between the electric motor 3 and gas delivery pump 4. The fuel pump 2, arranged between a valve 5 and a valve 6, takes in the main fuel from the main fuel tank 1, given an appropriate valve position 5. Via a valve 6, the main fuel reaches the main fuel line 9 to the one injection valve 12. Between valve 6 and the injection valve 12 there is a fuel pressure regulator 11 in the main fuel line 9, a return line 14 to the main fuel tank 1 being provided, starting from the fuel pressure regulator 11. Between valve 6 and the fuel pressure regulator 11 there is an additional valve 10 in the main fuel line 9.

The valve 5 is now set such that, by means of the fuel pump 2 driven by the electric motor 3, starting fuel is taken in from a starting fuel tank 13 and can either be introduced into the main fuel line 9 via the valve 6 or into the starting fuel line 15. Between valve 6 and the injection valve 12 there is a fuel pressure regulator 17 in the starting fuel line 15, a return line 18 to the starting fuel tank 13 being provided, starting from the fuel pressure regulator 17. Between valve 6 and the fuel pressure regulator 17 there is likewise an additional valve 16.

Figure 2:
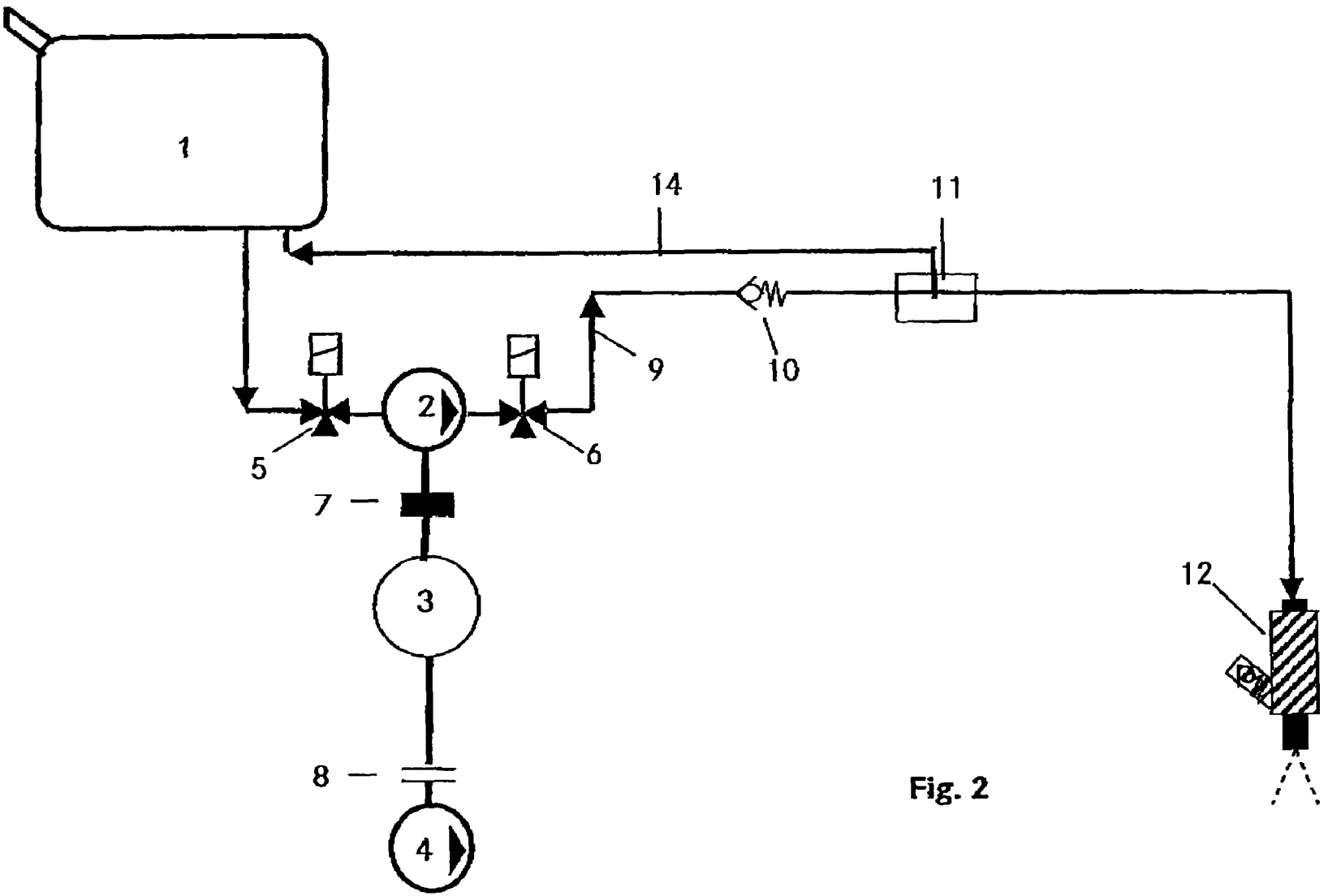
FIG. 2 shows the operation of a fuel supply system with main fuel following the conclusion of the warm-up period or during a warm-engine start of the motor vehicle.

In FIG. 2, the basic operation of a fuel supply system with main fuel following the conclusion of the warm-up period or during a warm-start of the motor vehicle is shown. For this purpose, the electric motor 3 drives the fuel pump 2 via the engaged clutch 7, the clutch 8 being disengaged. Valve 5, in particular a 3-way valve, preferably an electrically operated solenoid valve, is set such that the fuel pump 2 takes in main fuel from the main vehicle fuel tank 1. Via a valve 6, in particular a 3-way valve, preferably an electrically operated solenoid valve, the main fuel reaches the main fuel line 9 to the injection valve 12, which controls the injection into the internal combustion engine. Instead of an injection valve with a lateral nonreturn valve, a lance-like fuel distributor with nonreturn valve integrated into the lance can also be provided. A fuel pressure regulator 11 regulates the injection pressure into the internal combustion engine. Between valve 6 and the fuel pressure regulator 11 there is an additional valve 10 in the main fuel line, preferably a nonreturn valve.

Figure 3:
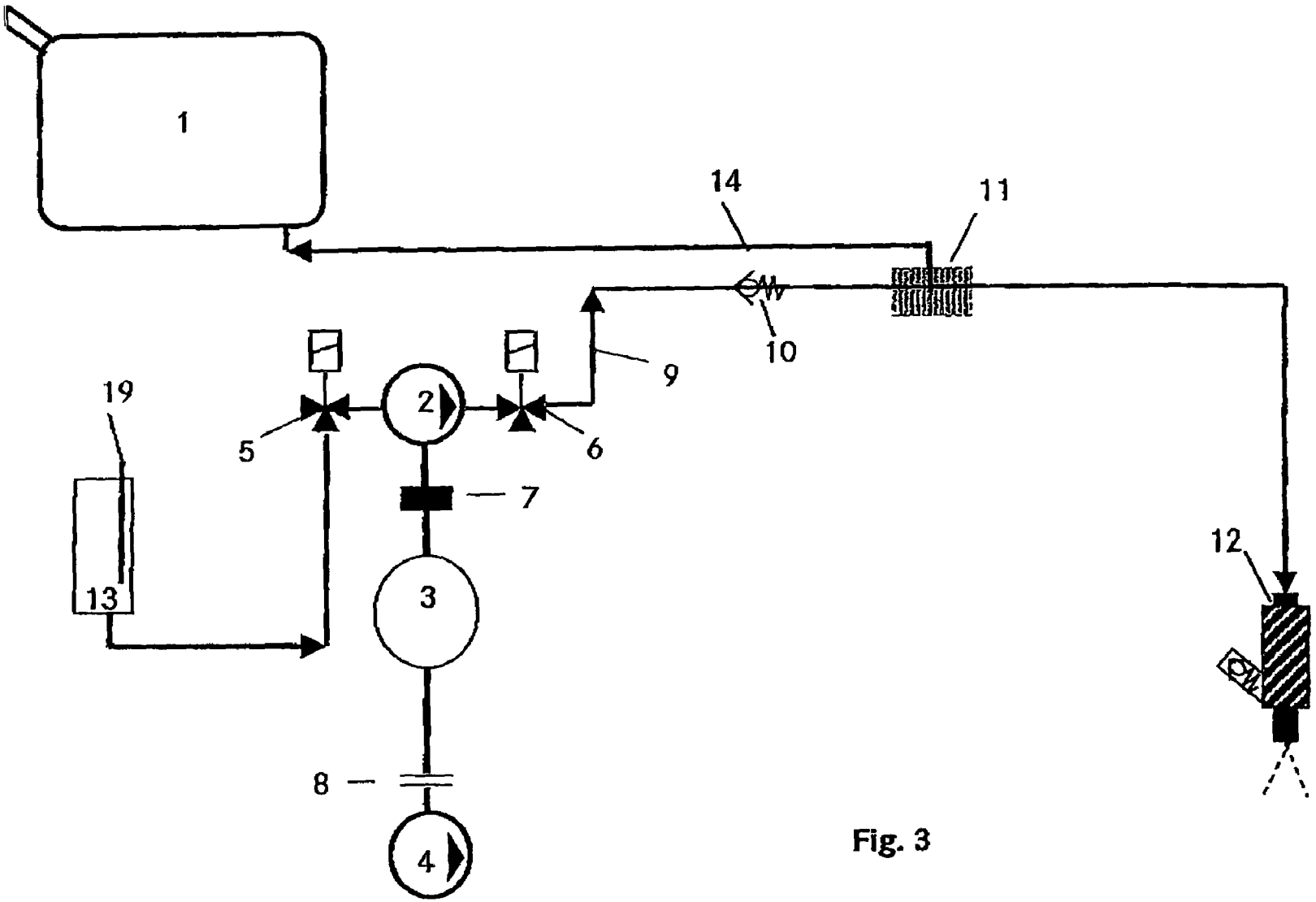
FIG. 3 shows the flushing of the fuel pump with starting fuel before the start of the internal combustion engine.

FIG. 3 describes schematically the flushing of the fuel pump 2 with starting fuel before starting the still cold internal combustion engine. In the fuel pump 2 there is a dead volume, which is filled with main fuel from the last time the vehicle was switched off. However, in order to be able to supply the internal combustion engine with pure starting fuel precisely at the beginning of the start, flushing with starting fuel is necessary. For this purpose, the electric motor 3 drives the fuel pump 2 via the engaged clutch 7. Clutch 8 is disengaged during this operation. The valve 5 is set such that the fuel pump 2 takes in starting fuel from the starting fuel tank 13 and delivers it into the main fuel line 9 via a valve 6. The starting fuel reaches the main fuel tank 1 via a fuel pressure regulator 11 and a fuel return line 14. The injection valve 12 for the internal combustion engine still remains closed during this operation. After a short time, valve 6 is changed over in such a way that the starting fuel reaches the starting fuel line 15, illustrated in FIG. 4. Between valve 6 and the fuel pressure regulator 17 there is an additional valve 16 in the starting fuel line 15, preferably a nonreturn valve. The cold internal combustion engine can now be started. During the cold-start and warm-up of the engine, the operation is carried out with starting fuel.

Figure 4:
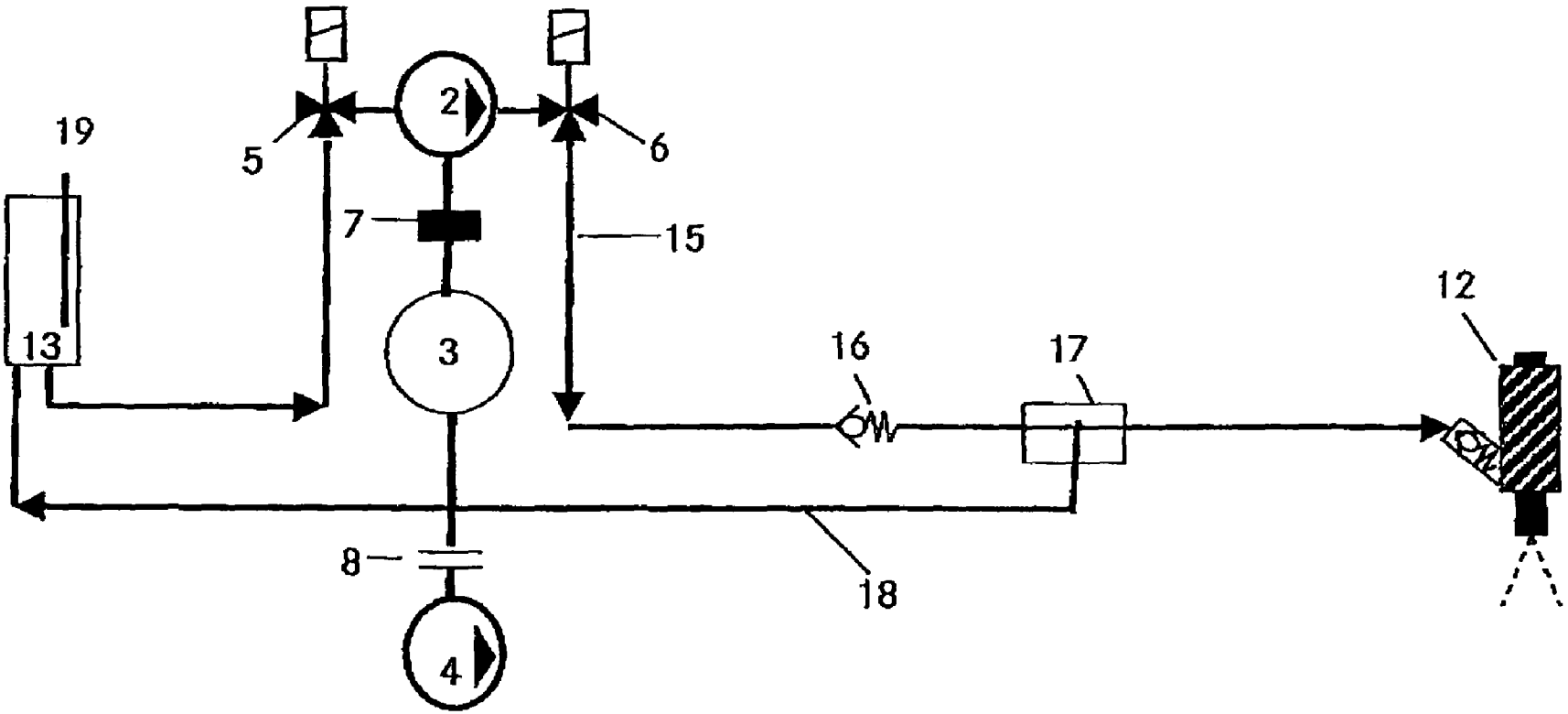
FIG. 4 shows the operation of a fuel supply system with starting fuel during cold-start and warm-up of the motor vehicle.

After the flushing with starting fuel has been carried out in accordance with FIG. 3, the valve 6, as shown in FIG. 4, is set such that the excess starting fuel passes back into the starting fuel tank 13 via the fuel pressure regulator 17 and a starting fuel return line 18. This saves starting fuel in an extremely advantageous manner. Following the conclusion of the warm-up, a change is made to operation with main fuel, as described in FIG. 2.

Figure 5:
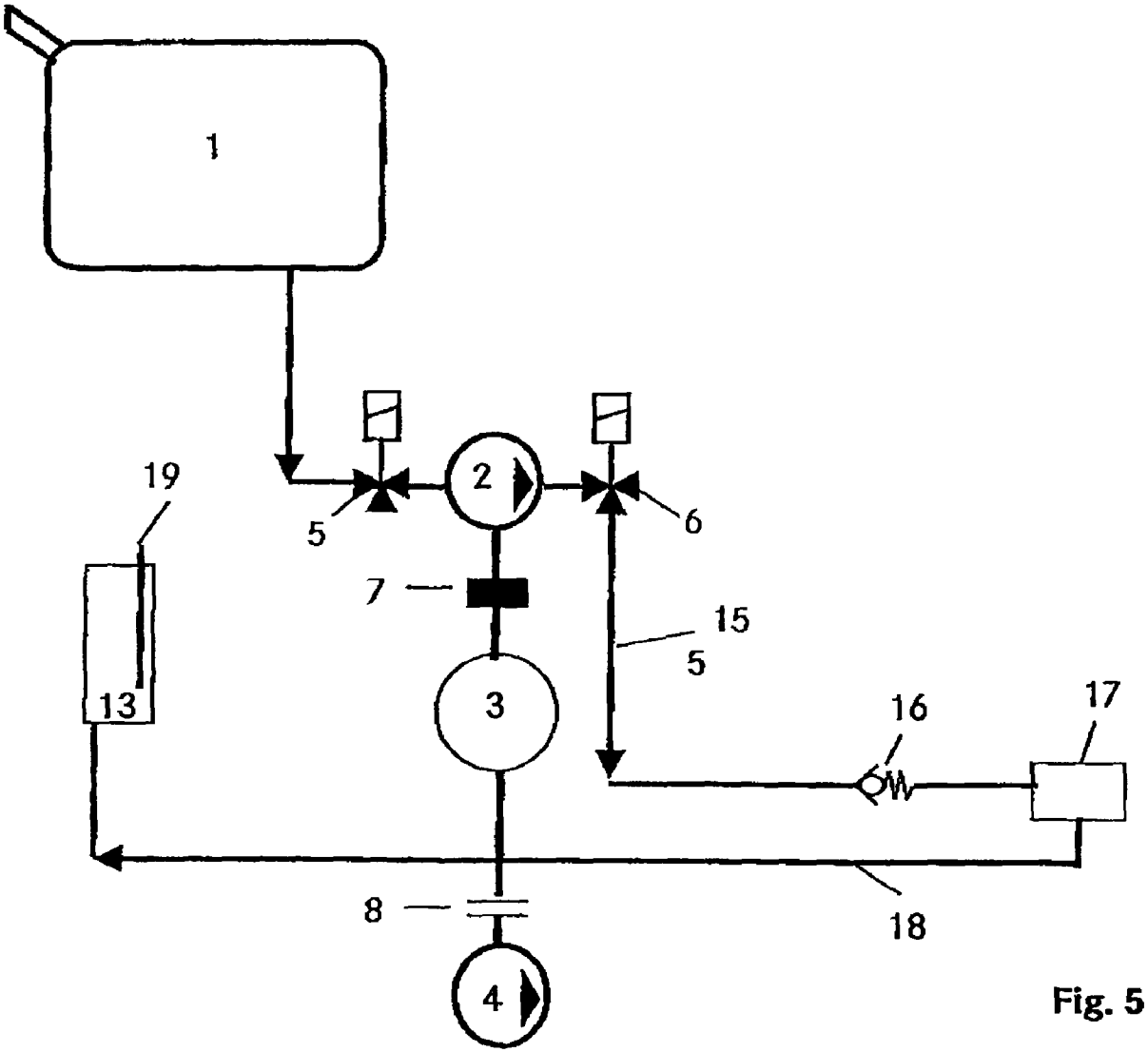
FIG. 5 shows the initial filling of the system with starting fuel.
Figure 6:
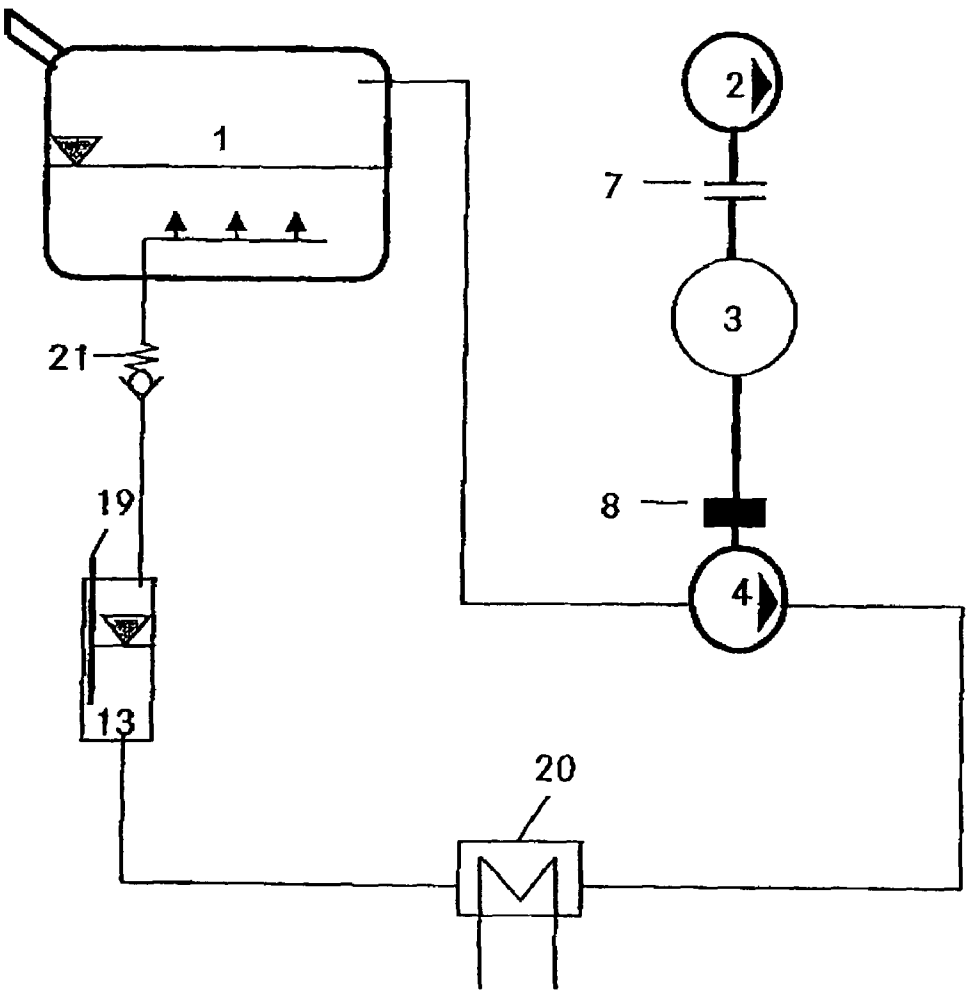
FIG. 6 shows the operation of the gas delivery pump during fractioning of the fuel.

The first filling with starting fuel is carried out, as shown in FIG. 5, during the first commissioning or following a repair, since in this situation there is still no starting fuel in the starting fuel tank 13 and in the starting fuel line 15. In order that, despite this, the first start can be carried out with starting fuel and the starting fuel line 15 can be filled, a small amount of starting fuel is put into the main fuel tank 1. The electric motor 3 drives the fuel pump 2 via the engaged clutch 7. In this case, the clutch 8 is disengaged. Valve 5 is set such that the fuel pump 2 takes in starting fuel from the main fuel tank 1. By way of the valve 6, the starting fuel reaches the starting fuel line 15 to the injection valve 12 of the internal combustion engine. The internal combustion engine can then be started. Via the pressure fuel regulator 17 and the starting fuel return line 18, the excess starting fuel passes back into the starting fuel tank 13 and fills the latter.

If, during the warm-up, the upper limiting value is indicated by the level meter 19 in the starting fuel tank, the valve 5 is changed over in such a way that the fuel pump 2 then takes starting fuel from the starting fuel tank, as shown in FIG. 4, until the warm-up has been concluded. After that, the main fuel tank 1 can be filled with main fuel.

Following the conclusion of the warm-up, the starting fuel consumed has to be topped up again by the operation of the gas delivery pump 4 of the fuel fractionation unit. This is illustrated schematically in FIG. 6. In this case, during the operation with main fuel, the clutch 8 is engaged, so that the gas delivery pump 4 is also driven. The latter takes in air and fuel vapor from the main fuel tank 1 and compresses the mixture. The mixture cools down in a following heat exchanger 20, so that the fuel fractions condense. The remaining air delivers the fuel condensate into the starting fuel tank 13, is depressurized to ambient pressure after the pressure relief valve 21 and passes into the main fuel tank 1 again via a distributor pipe. As the air bubbles rise through the fuel in the main fuel tank 1, they are enriched with the lower boiling-point fuel fraction. The circuit begins again. If the level meter 19 indicates the upper limiting value during the fractionation, the fractionation is ended by disengaging the clutch 8. If, before the upper limiting value is reached, the internal combustion engine should be switched off in the meantime, this means that the fuel pump 2 is switched off at the same time. In order that the fractionation can nevertheless be continued until the upper level mark has been reached, the clutch 7 can be disengaged and fractionation can be completed.

Previously known solutions describe a fuel circuit of a vehicle having an additional starting fuel circuit for reducing emissions, in particular in the cold-start phase. In this case, the delivery of the main fuel is carried out separately from the delivery of the starting fuel. This implies two separate drives for the respective pumps of the two separate systems.

In accordance with the present invention, by combining the fuel supply unit containing a pump unit and a starting fuel tank, which are integrated into the main fuel tank of an internal combustion engine, to form one structural unit, firstly, a reduction in the volume of such a fuel supply unit and also a substantially lower constructional outlay, and secondly, as a result of the use of the electric motor as a drive for both pump systems, that is the fuel pump and the gas delivery pump, an additional drive is dispensed with, such as would have been necessary in the case of separate operation of the two systems. The omission of the additional drive therefore leads to a cost reduction in the production of the component. Furthermore, in the event of maintenance of the fuel supply unit, this can be removed from the fuel container without great effort. Furthermore, the encapsulation of the pump unit results in an attenuated development of noise. Furthermore, the fuel supply unit configured in this way can be integrated without difficulty into any fuel container without the respective fuel container having to be adapted thereto. This shortens the development times considerably and saves the costs of the adaptation to the respective fuel container of a vehicle. By means of appropriate switching of the valves 5 and 6, during the first commissioning of a vehicle by means of a pump (the fuel pump 2), the invention additionally permits the immediate filling of the main fuel tank with starting fuel, which is then delivered to the starting fuel tank 13. This in turn contributes to the reduction in emissions during an initial start-up of the engine.

The operation of the fuel fractionation unit is based on the idea of entrained gas fractionation and this procedure is described extensively in patent specification DE 199 27 177 C1.

What is claimed is:

1. A fuel supply system for an internal combustion engine including a fuel tank (1) for liquid fuel having a gas space on top of any fuel stored therein, with a fuel feed line including a fuel pump (2) extending from the fuel tank (1) to a fuel injection valve (12), a fractionation device for separating low boiling-point fuel fractions from the fuel in the fuel tank (1) including a functional operating unit and a storage unit, the operating unit comprising a gas delivery pump (4) and an electric motor (3), and the storage unit comprising an additional tank (13) for the low boiling-point fuel fractions, said gas delivery pump (4) being connected to the gas space of the fuel tank (1) for taking in from the fuel tank gas enriched with low boiling fuel fractions and compressing the gas for condensation of the fuel, said gas delivery pump (4) being also connected to the additional tank (13) for supplying the compressed gas to the additional tank (13) for depositing the condensed low boiling fuel fraction therein, the electric motor (3) and the fuel pump (2) forming a pump unit, wherein the electric motor (3) is connected to the fuel pump (2) and to the gas delivery pump (4) by clutches (7, 8) such that the electric motor (3) can drive selectively either or both pumps (2, 4) and the gas delivery pump (4) can be operated even after engine shut down for replenishing the low boiling fuel in the additional tank (13).

2. The fuel supply system as claimed in claim 1, wherein at least one control valve (5, 6) is arranged at the intake and the pressure side of the fuel pump (2) in such a way that selectively liquid fuel from the fuel tank (1.) or fuel having low boiling-point fractions from the additional tank (13) can be delivered as desired by the fuel pump (2).

3. The fuel supply system as claimed in claim 1, wherein the pump unit (2, 3, 4) is incorporated into the fuel tank (1) of a vehicle.

4. The fuel supply system as claimed in claim 2, wherein excess fuel having low boiling-point fractions pumped by means of the fuel pump (2) can be returned to the additional tank (13) via a fuel return line (18) extending from a pressure regulator (17) disposed in a fuel return line (15) to the additional tank (13).

5. The fuel supply system as claimed in claim 2, wherein, during the first commissioning or after a repair of the fuel supply system of a motor vehicle, the first filling of the additional tank with starting fuel from the fuel tank can be carried out by operating the control values (5, 6) so as to pump low boiling starting fuel filled into the fuel tank (1) into the additional tank (13).

* * * * *